US005964108A

United States Patent [19]

McBride

[11] Patent Number: 5,964,108

[45] **Date of Patent: *Oct. 12, 1999**

[54] HIGH SECURITY LOCK

[76] Inventor: Darryl G. McBride, 127 Jim Charles Rd., Mocksville, N.C. 27028

[ * ] Notice: This patent is subject to a terminal disclaimer.

[21] Appl. No.: 09/005,200

[22] Filed: Jan. 9, 1998

[51] Int. Cl.[6] ..... E05B 67/22

[52] U.S. Cl. ..... 70/38 A; 70/340; 70/379 R; 70/419

[58] Field of Search ..... 70/38 R, 38 A, 70/38 B, 38 C, 490, 491, 356, 366, 419

[56] References Cited

U.S. PATENT DOCUMENTS

| | | | |
|---|---|---|---|
| 1,256,168 | 2/1918 | Schechter | 70/38 A |
| 2,391,834 | 12/1945 | Johnstone . | |
| 2,982,121 | 5/1961 | George | 70/419 |
| 4,802,354 | 2/1989 | Johnson | 70/491 |
| 4,934,164 | 6/1990 | Shew | 70/491 |
| 4,967,578 | 11/1990 | Shew et al. | 70/491 |
| 5,148,690 | 9/1992 | Wang | 70/38 A |
| 5,592,837 | 1/1997 | McBride . | |

FOREIGN PATENT DOCUMENTS

| | | | |
|---|---|---|---|
| 0277881 | 8/1988 | European Pat. Off. | 70/491 |

*Primary Examiner*—Darnell M. Boucher
*Attorney, Agent, or Firm*—Adams Law Firm. P.A.

[57] ABSTRACT

A high security lock includes a housing defining an interior chamber having a longitudinal chamber axis and a keyway axially through the housing into the chamber. A cam arrangement within the chamber defines an access in axial alignment with the keyway. The cam arrangement includes a plurality of stationary raceway cams arranged in parallel planes and concentric to the chamber axis. Each raceway cam has a radially-inward surface forming a bearing raceway. The cam arrangement further includes at least one stationary locking cam arranged in a plane parallel to the raceway cams and concentric to the chamber axis. The locking cam has no such bearing raceway. A tumbler assembly is disposed within the chamber and cooperates with the cam arrangement for selective rotational movement within the access about the chamber axis. The tumbler assembly includes a plurality of bearing elements supported for axial movement relative to the cam arrangement. A key is insertable into the keyway and has a plurality of shoulders adapted for engaging and moving the plurality of bearing elements axially from an inoperative disposition to an operative disposition. A locking member is mounted to the housing for movement between a retained position engaged by the tumbler assembly when in its locked disposition, and a released position disengaged by the tumbler assembly when in its unlocked disposition.

12 Claims, 6 Drawing Sheets

HIGH SECURITY LOCK

TECHNICAL FIELD AND BACKGROUND OF THE INVENTION

This invention relates generally to locks, especially padlocks and other key-operated locks, and relates more particularly to a novel internal locking mechanism which substantially eliminates the possibility of unauthorized opening of the lock by means of "picking". The invention is particularly adapted for use in padlocks, but will also be recognized and understood to be applicable to various other forms of key-operated locks where security reasons make it desirable to prevent picking of the lock mechanism.

Conventional padlocks are widely used in a diversity of applications, representing one of the most common forms of known security locks. Typically, such padlocks comprise a lock body which supports internally a series of rotatable or otherwise movable tumblers controlled by means of a compatibly profiled key insertable into the tumbler assembly through a keyway in the lock body to release and free one end of a shackle from the lock body when the key properly moves the tumblers into "unlocked" alignment with one another and to otherwise retain the shackle in a "locked" position withdrawn within the lock body.

Over the years, advances in metallurgy and hardening techniques have enabled the lock body and shackle to be fabricated of metals which substantially resist cutting and other forms of attempted tampering, thereby improving the security of such locks. Other forms of improvements have been undertaken with regard to the internal locking mechanism itself. However, one disadvantage suffered by substantially all conventional tumbler-type locks intended to be operated only by compatibly profiled keys is that only a moderate amount of skill is required of a person knowledgeable in the construction of such locks to manipulate the tumblers of the locks using a "feke" or similar device inserted into the keyway along with a tension wrench and thereby opening such a lock without its associated control key, a practice commonly referred to as "picking" the lock.

A further disadvantage of such locks is the availability of more than one correct combination for operating the lock. In this case, the security of the lock is substantially reduced.

SUMMARY OF THE INVENTION

Therefore, it is an object of the invention to provide improvements in key-operated locks which substantially minimize and largely eliminate the possibility of unauthorized "picking" of the lock.

It is another object of the invention to provide an internal locking mechanism for padlocks and similar key-operated locks which eliminates the use of conventional tumblers.

It is another object of the invention to provide a high security lock which includes only a single correct combination for operating the lock.

It is another object of the invention to provide a high security lock which can be readily modified to change its combination.

It is another object of the invention to provide a high security lock which uses operating pins which can be identical for all combinations.

These and other objects of the present invention are achieved in the preferred embodiments disclosed below by providing a high security lock including a housing defining an interior chamber having a longitudinal chamber axis and a keyway axially through the housing into the chamber. A cam arrangement within the chamber defines an access in axial alignment with the keyway. The cam arrangement includes a plurality of stationary raceway cams arranged in parallel planes and concentric to the chamber axis. Each raceway cam has a radially-inward surface forming a bearing raceway. The cam arrangement further includes at least one stationary locking cam arranged in a plane parallel to the raceway cams and concentric to the chamber axis. The locking cam has no such bearing raceway.

A tumbler assembly is disposed within the chamber and cooperates with the cam arrangement for selective rotational movement within the access about the chamber axis. The tumbler assembly includes a plurality of bearing elements supported for axial movement relative to the cam arrangement. A key is insertable into the keyway and has a plurality of shoulders adapted for engaging and moving the plurality of bearing elements axially from an inoperative disposition to an operative disposition. When in the operative disposition, each of the bearing elements resides adjacent a bearing raceway in a plane corresponding to the plane of one of the raceway cams. The bearing elements are thereby rotatable simultaneously along the respective raceways in at least two parallel planes without movement of the raceway cams. The tumbler assembly is rotated by the key between a locked disposition and an unlocked disposition. When in the inoperative disposition, the bearing elements are immovable annularly. A locking member is mounted to the housing for movement between a retained position engaged by the tumbler assembly when in its locked disposition, and a released position disengaged by the tumbler assembly when in its unlocked disposition.

According to one preferred embodiment of the invention, each of the plurality of raceway cams has a predetermined limited annular extent.

According to another preferred embodiment of the invention, the plurality of raceway cams include four raceway cams each having a bearing raceway with a 90 degree annular extent.

According to yet another preferred embodiment of the invention, the four raceway cams are arranged such that each bearing raceway resides in a different quadrant in the cam arrangement.

According to yet another preferred embodiment of the invention, the plurality of bearing elements include four bearing elements supported for axial movement relative to the cam arrangement. When in the operative disposition, the four bearing elements reside adjacent respective bearing raceways of the four raceway cams.

According to yet another preferred embodiment of the invention, each of the plurality of raceway cams is in a separate predetermined planar disposition axially relative to the chamber.

According to yet another preferred embodiment of the invention, one of the raceway cams has a continuous 360 degree raceway to accept a master key operative to position each of the plurality of bearing elements within the continuous raceway.

According to yet another preferred embodiment of the invention, the cam arrangement includes a plurality of locking cams.

According to yet another preferred embodiment of the invention, the tumbler assembly includes a plurality of slidable pins each having a head portion forming a respective one of the plurality of bearing elements.

According to yet another preferred embodiment of the invention, the plurality of slidable pins are identical to one another.

According to yet another preferred embodiment of the invention, the shoulders of the key define respective parallel axial recesses each of a selected length, a terminal end of each recess forming one of the shoulders.

According to yet another preferred embodiment of the invention, the lock is a padlock and the locking member is a shackle. One end of the shackle is freed from the housing in the released position and is captured within the housing in the retained position.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
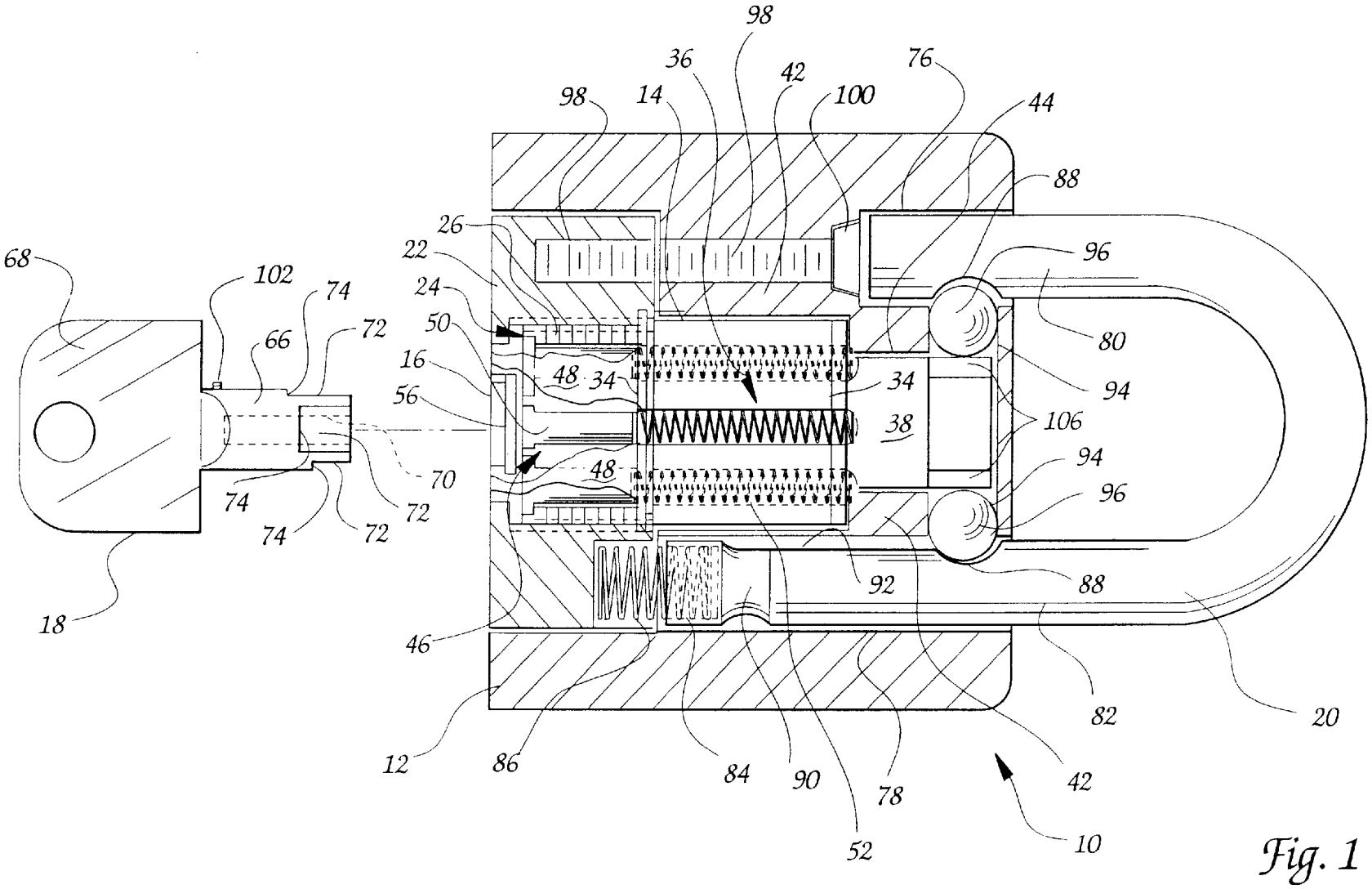
FIG. 1 is a vertical cross-sectional view of a padlock in accordance with one preferred embodiment of the present invention, shown in its locked condition.
Figure 2:
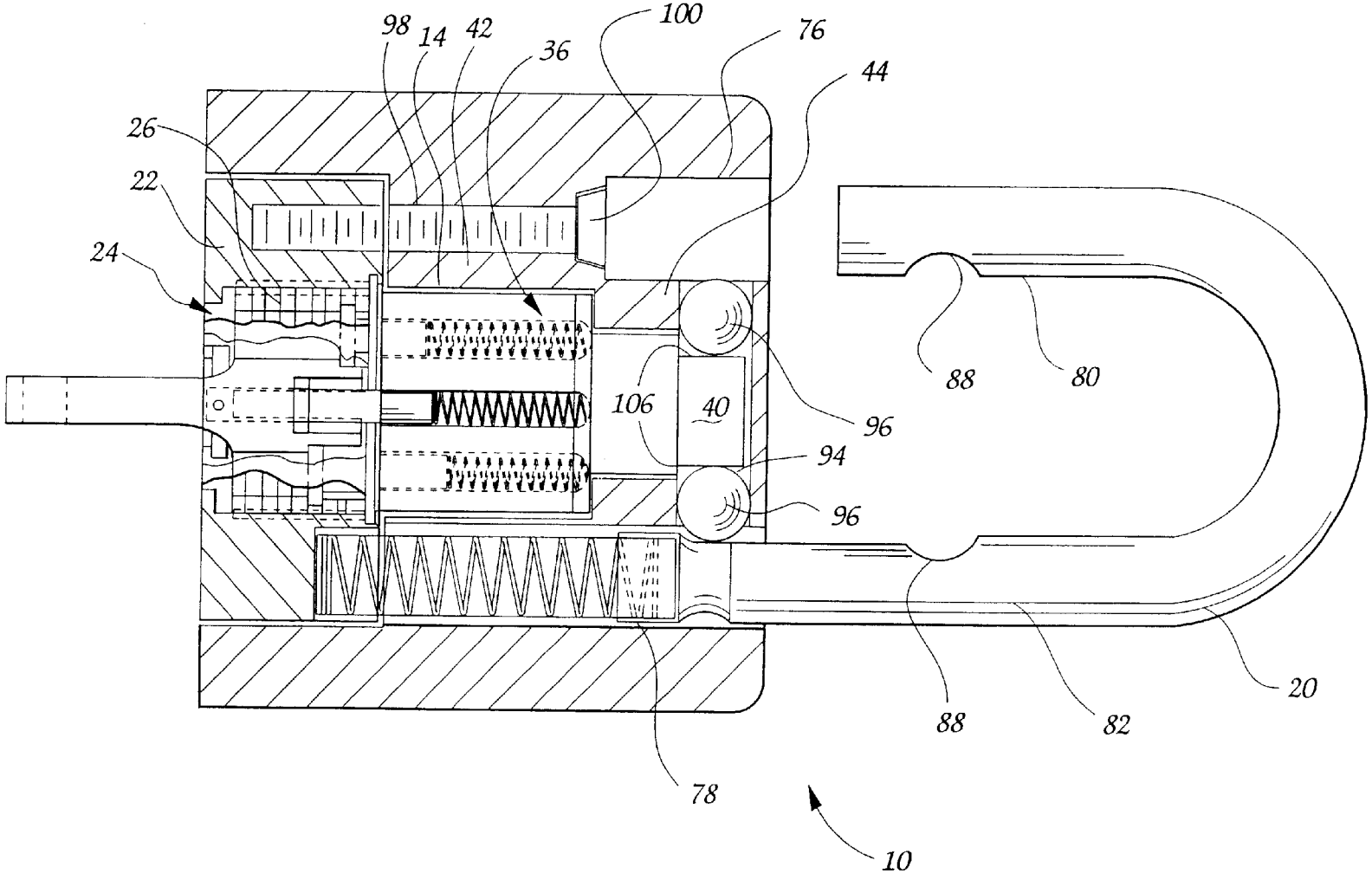
FIG. 2 is another vertical cross-sectional view of the padlock of FIG. 1, but shown in its unlocked condition.

Referring now specifically to the drawings, a high security lock according to the present invention is illustrated in FIG. 1 and shown generally at reference numeral 10. As those persons skilled in the relevant art will appreciate, it is to be understood that the present invention is not limited or otherwise restricted to the particular construction or components depicted in the accompanying drawings, the padlock 10 being illustrated and described herein solely for purposes of disclosing one representative example of an embodiment of the present invention.

The padlock 10 includes a cylindrical lock body or housing 12 which is at least partially hollow internally to define an interior locking chamber 14 concentrically about a longitudinal chamber axis X of the lock body 12 for receiving and housing the locking mechanism of the padlock 10, more fully described below. One axial end of the lock body 12 defines a keyway 16 coaxially into the interior locking chamber 14 for insertion and removal of an operating key 18 for locking and unlocking operation of the padlock 10, as described hereinafter, and the opposite end of the lock body 12 is formed with two cylindrical bores which receive the opposite ends of a looped J-shaped shackle 20.

The lock body 12 includes a cylindrical insert 22 fitted securely within the first-mentioned end of the lock body 12 concentrically with respect to the chamber 14, the keyway 16 being formed in an outwardly facing end surface of the cylindrical insert 22. A cam arrangement, indicated in its totality at 24, is fixed interiorly within the cylindrical insert 22 immediately adjacent and encircling the keyway 16, the cam arrangement 24 including a plurality of annular cam rings 26A–26I securely fitted and supported within the cylindrical interior of the insert 22 in stacked parallel relation to one another.

Each of the cam rings 26A–26I has a circular outer periphery formed at equidistant circumferential spacings with a semicircular recess 28 (see FIG. 3) which are aligned with one another in the stacked disposition of the cam rings 26A–26I. One set of the aligned recesses 28 in the cam rings 26A–26I receives a cylindrical keypin 30 (see also FIG. 3) which also fits within a corresponding axially extending semicircular recess 32 formed in the annular interior face of the insert 22, thereby to secure the cam rings 26A–26I against undesired rotation relative to the insert 22. Likewise, a lock ring 34 is fitted within the interior of the insert 22 at its inwardmost end to retain the cam rings 26A–26I in stacked relation against undesired axial movement relative to the insert 22.

A tumbler assembly, indicated in its totality at 36, is disposed coaxially within the interior locking chamber 14 for selective rotational movement relative to the cam arrangement 24 under the operating control of the key 18, in a manner more fully described hereinafter. The tumbler assembly 36 includes a central cylindrical body 38 supported centrally within the chamber 14 of the lock body 12 by a correspondingly cylindrical bearing portion 42 of the lock body 12. A shackle-operating hub 40 is formed integrally with the main tumbler body 38 to project axially into a reduced diameter bore 44 in the bearing portion 42 to control locking retention and unlocking release of the shackle 20 in dependance upon the rotational disposition of the tumbler assembly 36, as described hereinafter. The tumbler assembly 36 also includes a locking mechanism 46 projecting axially from its opposite end to be disposed concentrically within the cam arrangement 24.

The locking mechanism 46 includes four support arms 48 formed integrally with the cylindrical main body 38 of the tumbler assembly 36 to extend in axially parallel relation to one another at equal circumferential spacings at the outer cylindrical periphery of the tumbler body 38. Disposed between the four support arms 48 are four identical operating pins 50, each slidably received in an axial bore 52 (FIG. 1) formed in the main cylindrical body 38 of the tumbler assembly 36 and biased outwardly by a corresponding coil spring 54 disposed within the respective bore 52. Each operating pin 50 has an enlarged head 56 at its axially outwardmost free end, the heads 56 being sufficiently enlarged to extend radially outwardly from the support arms 48, with each head 56 also being formed with laterally opposed recesses 58 to receive adjacent guide edges of the support arms 48, whereby the support arms 48 guide axial sliding movement of the operating pins 50 within their respective bores 52. A key centering pin 60 (FIG. 3) extends from the axial center of the main cylindrical body 38 of the tumbler assembly 36 centrally within and in parallel relation to the support arms 48.

Description of Cam Rings 26A–26I

The cam rings 26A–26I of the cam arrangement 24 are formed with a particular profiled configuration at their respective radially inwardly facing annular surfaces. Each of the cam rings 26A–26I includes a number of spaced recesses 62 which align with one another in the stacked cam arrangement 24 to accommodate axial sliding movement of the pin heads 56 of the tumbler assembly 36 within the recesses 62.

Figure 4:
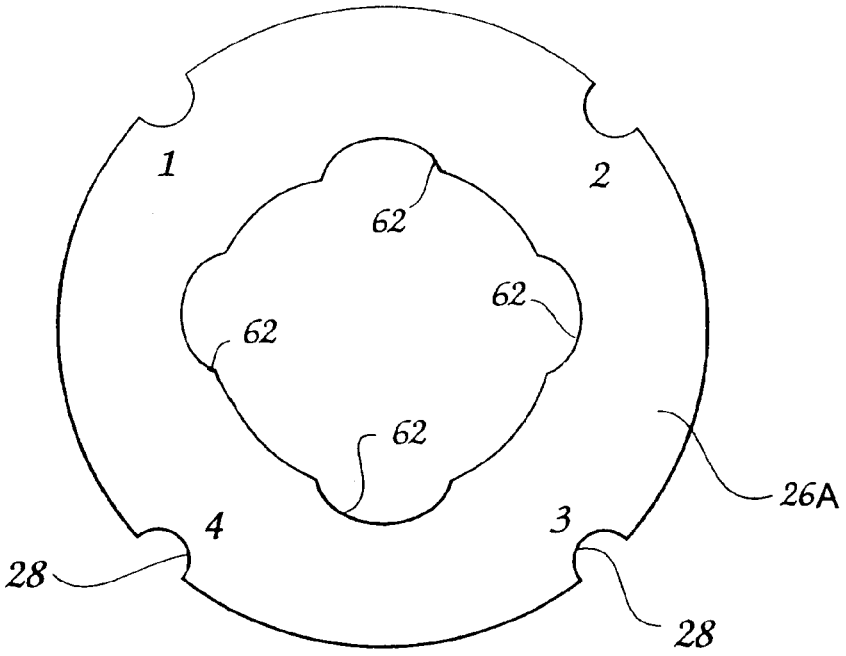
FIG. 4 is a plan view of a locking cam ring for the padlock of FIGS. 1–3.

According to the embodiment shown, the cam rings 26A, 26B, 26D, 26G, and 26I are locking cam rings. The cam rings 26C, 26E, 26F, and 26H are raceway cam rings. The locking cam rings 26A, 26B, 26D, 26G, and 26I are formed with four equidistant semicircular recesses 62 in their radially inward annular surface. A portion of each locking cam ring 26A, 26B, 26D, 26G, and 26I between the recesses 62 projects sufficiently radially inward to laterally engage the pin heads 56 and thereby prevent rotational movement of the tumbler assembly 36. A single locking cam ring, such as locking cam ring 26A, is shown in FIG. 4.

Each raceway cam ring 26C, 26E, 26F, and 26H likewise includes recesses 62, and at least one quadrant (i.e., the arcuate area between adjacent recesses 62) which is removed to form a bearing raceway 64 extending approximately 90 degrees about the respective cam ring, thereby permitting a respective pin head 56 to travel 90 degrees within the raceway 64 between the adjacent recesses 62. In order to rotate the tumbler assembly 36, each of the four pin heads 56 must travel 90 degrees in unison within raceways 64 formed collectively in each of the four quadrants of the raceway cam rings 26C, 26E, 26F, and 26H. Operation of the tumbler assembly 36 and padlock 10 is described further below.

To allow for only a single correct combination for the padlock 10, only one single-quadrant raceway (See e.g., FIG. 5) is formed in each of the four raceway cam rings 20 26C, 26E, 26F, and 26H, and the raceway cam rings 26C, 26E, 26F, and 26H are arranged such that the collective annular extent of the raceways 64 is 360 degrees. Thus, the maximum number of raceway cams rings in the cam arrangement 24 is four, while the minimum number of raceway cam rings is one (See e.g., FIG. 8). Preferably, all cam rings of the cam arrangement 24 which are not raceway cam rings are locking cam rings.

Figure 5:
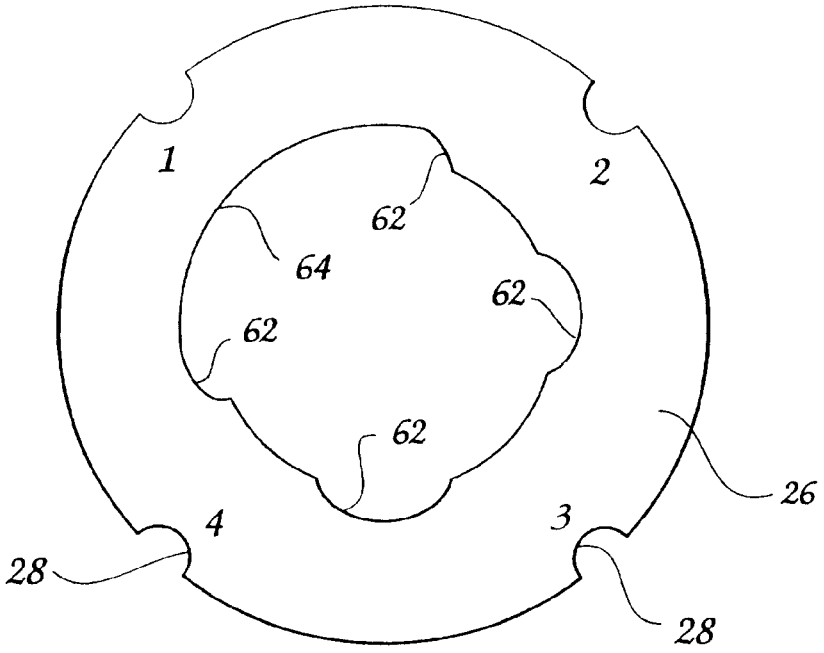
FIGS. 5–8 are plan views of three differing possible raceway cam rings for the padlock of FIGS. 1–3.
Figure 6:
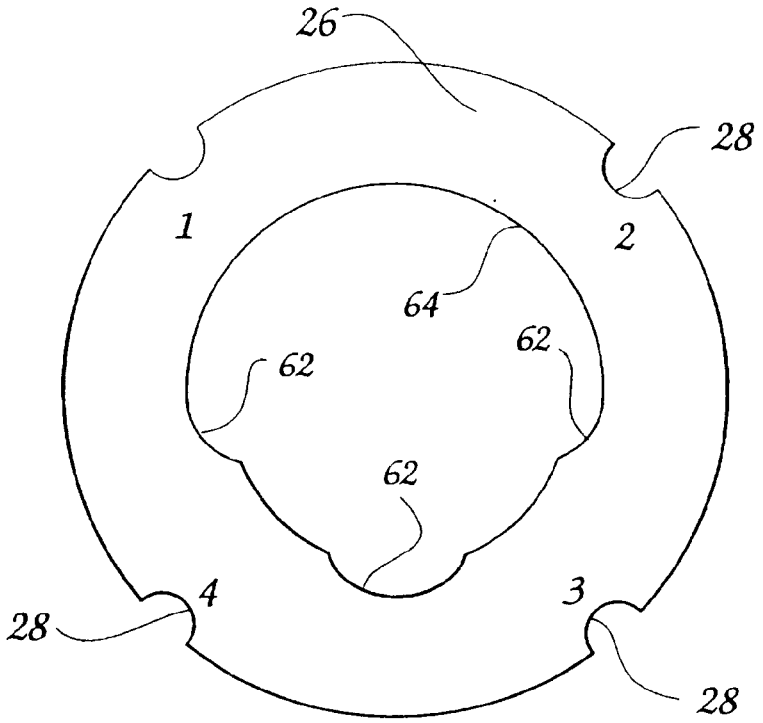
Figure 7:
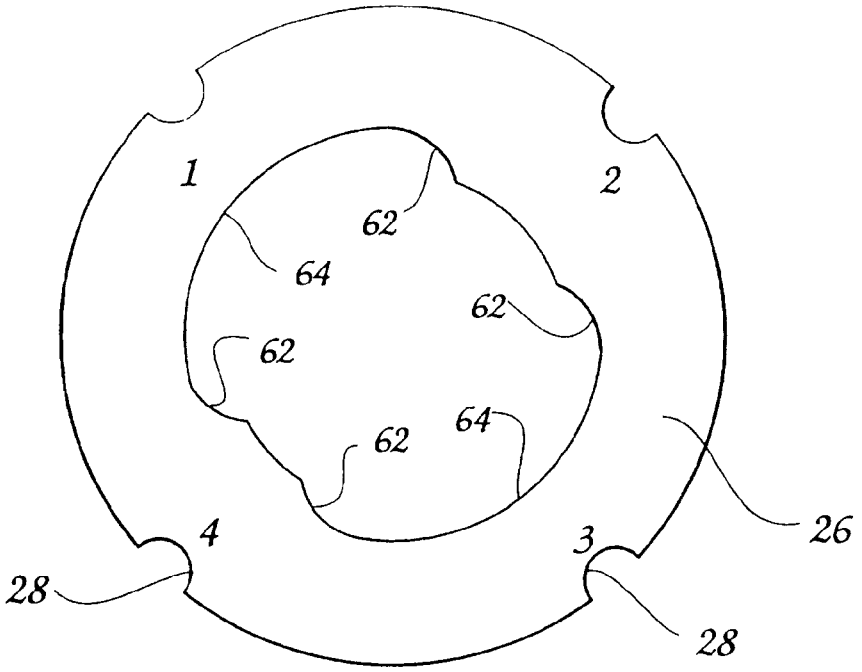

FIGS. 5, 6, and 7 illustrate three possible raceway cam ring designs, it being understood that other cam ring designs are of course possible. FIG. 5 shows a raceway cam ring 26 with a single 90 degree raceway formed in quadrant 1. FIGS. 6 and 7 show respective cam rings 26 with raceways 64 formed in two different quadrants, such that two of the four pin heads 56 can travel within the same raceway cam ring 26 upon rotation of the tumbler assembly 36. In FIG. 6, for example, adjacent quadrants 1 and 2 of the raceway cam ring 26 are removed to form a continuous 180 degree raceway 64. In FIG. 7, two distinct 90 degree raceways 64 are formed in quadrants 1 and 3.

Hence, the arrangement of the cam rings 26A–26I normally prevents rotation of the tumbler assembly 36 except only when all of the heads 56 of the operating pins 50 are depressed against the biasing force of their respective springs 54 to respective levels at which the pin heads 56 simultaneously reside within respective raceways 64 of the raceway cam rings 26C, 26E, 26F, and 26H so as to permit all of the pin heads 56 to simultaneously move 90 degrees in the same rotational direction. Because only one raceway 64 is provided in each of the four quadrants, such that the collective annular extent of the raceways 64 is 360 degrees, only one correct combination is possible for operating the padlock 10. Preferably, the locking cam rings 26A, 26B, 26D, 26G, and 26I are intermixed with the raceway cam rings 26C, 26E, 26F, and 26H in the stacked cam arrangement 24 to allow for the manufacture of thousands of padlocks 10 each with its own unique combination. Additional locking cam rings can be readily incorporated into the cam arrangement 24 in order to increase the availability of unique combinations.

Figure 8:
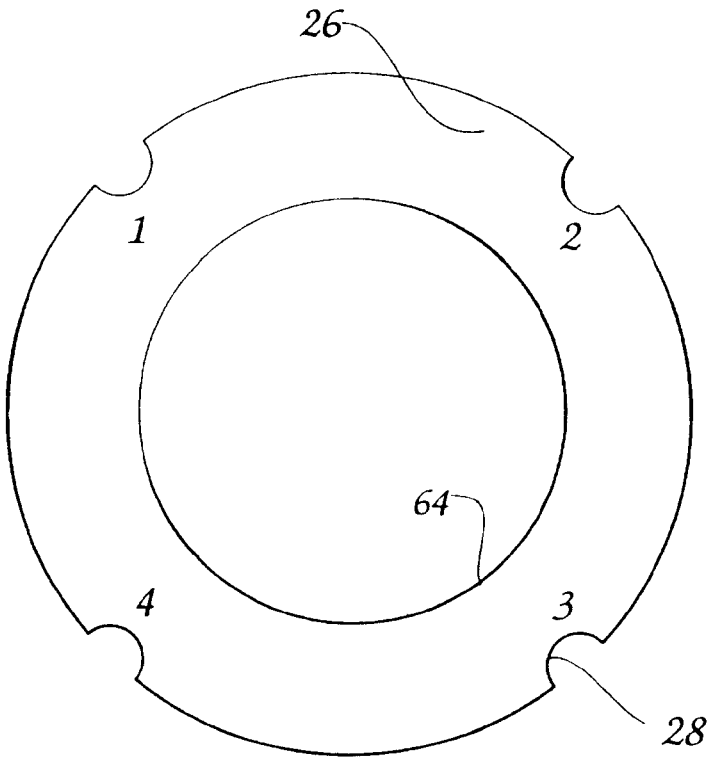

FIG. 8 illustrates yet another possible raceway cam ring configuration wherein the raceway 64 extends continuously the full 360 degree annular extent of the raceway cam ring 26. This raceway cam ring 26 can be used alone in combination with a number of other locking cam rings, or as a master cam ring allowing the addition of a second correct combination for a particular padlock 10. In the latter case, the padlock 10 is capable of being operated not only by its own key, but also by a master key operative to depress the pin heads 56 simultaneously into the raceway of the master cam ring. Such is the function of the key 18.

Operation of the Key 18

As depicted in the drawings, the key 18 has an operating shaft 66 of a generally cylindrical configuration formed integrally with a flat flange portion 68 by which the key shaft 66 may be manually turned. The shaft 66 is of a substantially cylindrical configuration to be insertable into the keyway 16 and into the locking mechanism 46 of the tumbler assembly 36, and the shaft 66 has an axial length sufficient to extend the axial length of the cam arrangement 24 when so inserted. A bore 70 is formed in the free end of the key shaft 66 to receive the key centering pin 60 of the tumbler assembly 36 when so inserted.

The cylindrical periphery of the key 18 is formed with four equidistantly spaced axial recesses 72, each terminating in a radial shoulder 74. As will thus be understood, when the shaft 66 of the key 18 is inserted into the keyway 16 and therefrom into the locking mechanism 46 of the tumbler assembly 36, the axial recesses 72 initially receive the respective pin heads 56 and ultimately engage the pin heads by the radial shoulders 74 to depress each respective pin head 56 against its biasing spring 54. By selective determination of the respective axial length of each recess 72 and the attendant axial disposition of the associated shoulder 74, the distance to which each pin head 56 is depressed upon insertion of the key 18 can be selectively determined and, in turn, the key 18 can be profiled to properly depress the pin heads 56 simultaneously to the correct respective levels at which the tumbler assembly 36 is permitted to rotate with the pin heads 56 in respective raceways 64 of the cam rings 26A–26I.

The axial end of the lock body 12 opposite the keyway 16 is formed with a pair of bores 76, 78 extending axially through the lock body 12 at diametrically opposed locations radially outwardly of the interior bore 44 so as to extend axially through the bearing portion 42 of the lock body 12, for receiving the opposite ends of the shackle 20. As aforementioned, the shackle 20 is of a looped J-shaped configuration forming two shackle legs 80 and 82 extending in spaced parallel relation to one another, with the leg 82 being of a substantially greater length than the leg 80 to serve as a mounting leg for the shackle 20. The bore 78 is adapted to receive the shackle mounting leg 82 and is therefore formed to extend completely through the bearing portion 42 of the lock body 12, with an aligned recess 86 also being formed in the adjacent portion of the end face of the cylindrical cam insert 22 to form a seat for a biasing spring 84 extending axially into the bore 78 to act upon the inward end of the shackle mounting leg 82, whereby the shackle 20 is urged by the spring 84 axially outwardly from the lock body 12 into an opened condition wherein the other shackle leg 80 is freed from the lock body 12.

The inwardly facing surfaces of the shackle legs 80, 82 are respectively formed with arcuate recesses 88, located in the shackle leg 80 immediately adjacent its free end and in the shackle leg 82 directly opposite the recess 88 in the shackle leg 80. Additionally, the shackle leg 82 is formed further with a recess 90 of an arcuate profile extending continuously about the full annular extent of the shackle leg 82 immediately adjacent its free end, with the intermediate length of the shackle leg 82 between its recesses 88, 90 being flattened at 92 to form a bearing race between the two recesses 88, 90.

A pair of bores 94 are formed in the lock body 12 to extend in alignment with one another radially between the interior bore 44 and the respective bores 76, 78 for the shackle legs 80, 82, and a pair of ball bearings 96 are seated in such bores 94 to move radially therein between a locking disposition projecting radially outwardly into the bores 76, 78 to engage in the shackle recesses 88 and thereby retain both shackle legs 80, 82 against withdrawal outwardly from the lock body 12 and an unlocked disposition projecting radially inwardly into the interior bore 44 permitting release of the shackle legs 80, 82. In the unlocked disposition of the ball bearings 96, the spring 84 is permitted to act upon the inward end of the shackle leg 82 to push the shackle 20 outwardly from the lock body 12, but the ball bearing 96 adjacent the corresponding shackle bore 78 still projects sufficiently into the bore 78 to ride along the bearing race 92 and engage the enlarged terminal end of the shackle leg 82 so as to prevent complete removal of the shackle 20 from the lock body 12.

A screw bore 98 may be formed axially through the lock body 12 between the terminal inward end of the shackle bore 76 and the interior chamber 14 in order to receive a screw 100 threaded into the cylindrical insert 22. In this manner, the screw 100 assists in retaining the cylindrical insert 22 in fixed disposition within the chamber 14 against undesired rotational movement of the insert 22, with access to the screw 100 being prevented except upon authorized opening of the lock 10. Of course, those persons skilled in the art will readily recognize and understand that many other means exist for securing the insert 22 within the lock body 12.

Operation of the Lock 10

The operation of the present lock 10 is as follows. In the locked condition of the padlock 10 shown in FIG. 1, the key 18 is removed from the keyway 16 and the tumbler assembly 36 resides in a rotational disposition within the access defined by the cam arrangement 24 in which the shackle operating hub 40 of the tumbler assembly 36 is rotated to force the ball bearings 96 outwardly into engagement within the recesses 88 in the shackle legs 80, 82 to retain both shackle legs locked within their respective bores 76, 78.

Figure 3:
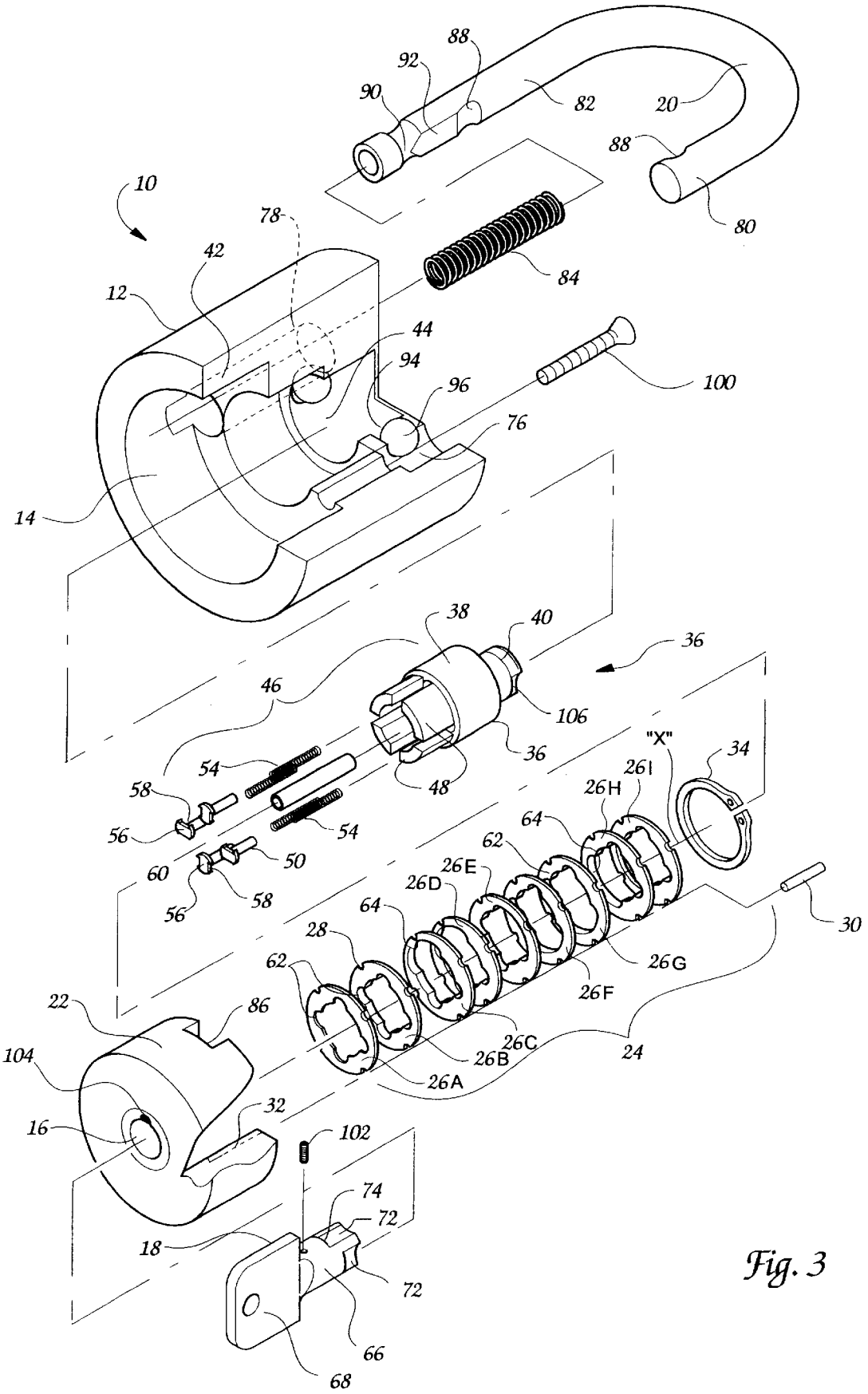
FIG. 3 is an exploded perspective view of the individual components of the padlock of FIGS. 1 and 2.

As noted in FIG. 3, the key shaft 66 is formed with a radial protuberance 102 and the keyway 16 is similarly formed with a corresponding radial recess 104 to guide correct insertion of the key 18 into the keyway 16. Upon such correct insertion of the key 18 fully into the keyway 16, the radial shoulders 74 on the key shaft 66 respectively engage and depress the pin heads 56 to respective levels at which each of the pin heads 56 reside in a corresponding one of the cam raceways 64, thereby permitting the key 18 to rotate the entire tumbler assembly 36. The shackle operating hub 40 of the tumbler assembly 36 is formed at diametrically opposed sides with ball bearing recesses 106 which are thereby rotated with the tumbler assembly 36 into direct alignment with the radial bores 94 so as to permit the ball bearings 96 therein to move radially inwardly out of the shackle recesses 88 and into the ball bearing recesses 106 of the tumbler hub 40, thereby releasing the shackle 20 for withdrawal from the lock body 12. As aforementioned, the ball bearing 96 associated with the shackle bore 78 still projects sufficiently into the bore 78 to engage in the annular recess 90 so as to prevent complete removal of the shackle 20.

As will thus be understood, the particular mechanical arrangement of the lock 10 provides secure locking and unlocking operation comparable if not superior to any conventional padlock or other key-operated lock. Advantageously, after opening of the lock 10, the key 18 is always retained within the lock body 12 against removal from the keyway 16 by means of the radial protuberance 102 until the freed leg 80 of the shackle 20 is returned into its bore 76 permitting the key 18 to be rotated in reverse and removed. In this manner, the lock 10 provides the advantage of preventing undesired loss of the key 18. A much more significant advantage of the present lock is that the unique construction of the tumbler assembly 36, particularly its provision of circumferentially spaced operating pins 50, in conjunction with the provision of the stacked cam rings 26A–26I of the cam arrangement 24, makes it extremely difficult, if not essentially impossible, to accomplish unauthorized opening of the lock by "picking" because, unless and until the operating pins 50 are simultaneously depressed to and held at the respectively differing levels determined by the associated cam rings 26A–26I, the tumbler assembly 36 cannot be turned.

Without the unique key 18 of the present invention, it would be virtually impossible to so manipulate the operating pins 50 and then also induce rotation of the tumbler assembly 36. Hence, the lock 10 of the present invention provides markedly superior security against unauthorized opening than any known conventional padlock or comparable key-operated lock.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A high security lock comprising:

(a) a housing defining an interior chamber having a longitudinal chamber axis and a keyway axially through said housing into said chamber;

(b) a cam arrangement within said chamber and defining an access therethrough in axial alignment with said keyway, said cam arrangement comprising:

(i.) a plurality of stationary raceway cams arranged in parallel planes and concentric to said chamber axis, and each having a radially-inward surface forming a bearing raceway; and (ii.) at least one stationary locking cam arranged in a plane parallel to said raceway cams and concentric to said chamber axis, said locking cam having no such bearing raceway;

(c) a tumbler assembly disposed within said chamber and cooperating with said cam arrangement for selective rotational movement within said access about the chamber axis, said tumbler assembly including a plurality of bearing elements supported for axial movement relative to said cam arrangement;

(d) a key insertable into said keyway and having a plurality of shoulders adapted for engaging and moving said plurality of bearing elements axially from an inoperative disposition to an operative disposition, such that:

(i.) when in said operative disposition, each of said bearing elements resides adjacent a bearing raceway in a plane corresponding to the plane of one of said raceway cams, and said bearing elements being rotatable simultaneously along the respective raceways in at least two parallel planes without movement of said raceway cams, whereby said tumbler assembly is rotated by said key between a locked disposition and an unlocked disposition, and (ii.) when in said inoperative disposition, said bearing elements are immovable annularly; and (e) a locking member mounted to said housing for movement between a retained position engaged by said tumbler assembly when in its said locked disposition and a released position disengaged by said tumbler assembly when in its said unlocked disposition.

2. A high security lock according to claim 1, wherein each of said plurality of raceway cams has a predetermined limited annular extent.

3. A high security lock according to claim 2, wherein said plurality of raceway cam comprises four raceway cams each having a bearing raceway with a 90 degree annular extent.

4. A high security lock according to claim 3, wherein said four raceway cams are arranged such that each bearing raceway resides in a different quadrant in said cam arrangement.

5. A high security lock according to claim 4, wherein said plurality of bearing elements comprise four bearing elements supported for axial movement relative to said cam arrangement and, when in the operative disposition, said four bearing elements reside adjacent respective bearing raceways of said four raceway cams.

6. A high security lock according to claim 1, wherein each of said plurality of raceway cams is in a separate predetermined planar disposition axially relative to said chamber.

7. A high security lock according to claim 1, wherein one of said raceway cams has a continuous 360 degree raceway to accept a master key operative to position each of said plurality of bearing elements within said continuous raceway.

8. A high security lock according to claim 1, wherein said cam arrangement comprises a plurality of locking cams.

9. A lock according to claim 1, wherein said tumbler assembly comprises a plurality of slidable pins each having a head portion forming a respective one of said plurality of bearing elements.

10. A lock according to claim 9, wherein said plurality of slidable pins are identical to one another.

11. A lock according to claim 1, wherein the shoulders of said key define respective parallel axial recesses each of a selected length, a terminal end of each said recess forming one of said shoulders.

12. A lock according to claim 1, wherein said lock is a padlock and said locking member is a shackle, one end of which is freed from said housing in said released position and is captured within said housing in said retained position.

* * * * *

UNITED STATES PATENT AND TRADEMARK OFFICE

CERTIFICATE OF CORRECTION

PATENT NO. : 5,964,108
DATED : October 12, 1999
INVENTOR(S) : McBride, Darryl G.

It is certified that error appears in the above-identified patent and that said Letters Patent is hereby corrected as shown below:

Substitute Figure 3 (Sheet 3 of 6) with Figure 3 shown below:

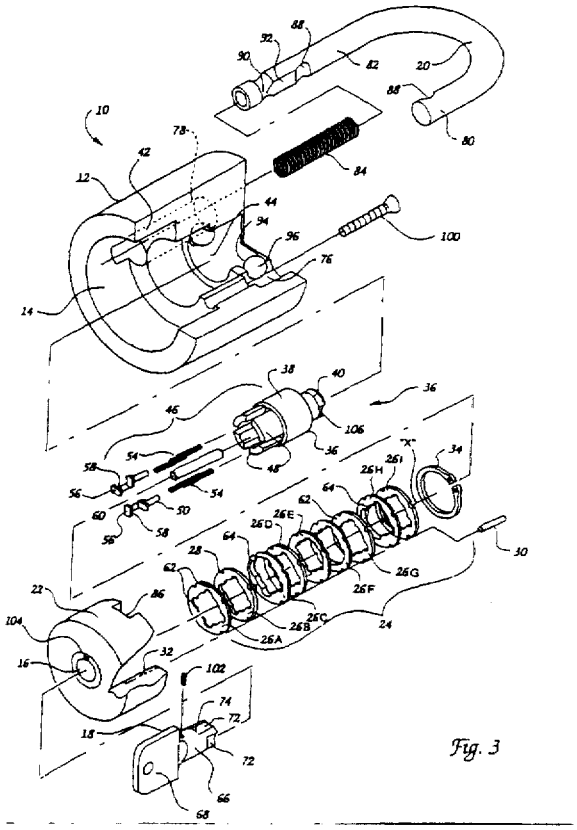

Fig. 3

Signed and Sealed this

Ninth Day of October, 2001

*Attest:*

Nicholas P. Godici

*Attesting Officer*

NICHOLAS P. GODICI
*Acting Director of the United States Patent and Trademark Office*